US008365663B2

(12) United States Patent
Kim et al.

(10) Patent No.: US 8,365,663 B2
(45) Date of Patent: Feb. 5, 2013

(54) METHOD OF FORMING INK PATTERNS AND APPARATUS FOR PRINTING INK PATTERNS

(75) Inventors: Bo-Sung Kim, Seoul (KR); Kyu-Young Kim, Suwon-si (KR); Youn-Gu Lee, Suwon-si (KR); Chang-Hoon Kim, Asan-si (KR); Nam-Ok Jung, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 529 days.

(21) Appl. No.: 12/691,596

(22) Filed: Jan. 21, 2010

(65) Prior Publication Data

US 2011/0023736 A1 Feb. 3, 2011

(30) Foreign Application Priority Data

Jul. 28, 2009 (KR) ..... 10-2009-0068866

(51) Int. Cl.

| | |
|---|---|
| ***B41F 1/16*** | (2006.01) |
| ***B41F 33/00*** | (2006.01) |
| ***B41F 11/00*** | (2006.01) |
| ***B41F 7/02*** | (2006.01) |
| ***B41F 9/00*** | (2006.01) |

(52) U.S. Cl. ..... 101/492; 101/483; 101/215; 101/217; 101/154

(58) Field of Classification Search ..... 101/158, 101/154, 492, 215, 450.1
See application file for complete search history.

(56) References Cited

U.S. PATENT DOCUMENTS

| | | | | |
|---|---|---|---|---|
| 5,335,595 | A * | 8/1994 | Yamashita et al. | 101/158 |
| 5,996,488 | A * | 12/1999 | Yanagisawa et al. | 101/170 |
| 7,987,782 | B2 * | 8/2011 | Kim et al. | 101/217 |
| 2010/0139513 | A1 * | 6/2010 | Seong et al. | 101/252 |

FOREIGN PATENT DOCUMENTS

| | | |
|---|---|---|
| JP | 2007-069553 | 3/2007 |
| JP | 2007-083408 | 4/2007 |
| KR | 10-2003-0058162 A | 7/2003 |
| KR | 10-2008-0021023 A | 3/2008 |

* cited by examiner

*Primary Examiner* — Judy Nguyen
*Assistant Examiner* — Justin Olamit
(74) *Attorney, Agent, or Firm* — Innovation Counsel LLP

(57) ABSTRACT

A method of forming ink patterns and an apparatus for printing ink patterns capable of reducing the amount of wasted ink and enhancing the printing and positional precision of the shape of ink patterns on a member to be printed, are described herein. The method includes providing a first printing member including first concave portions formed by engraving patterns larger than final ink patterns, that are to be printed on a member, on the first printing member; filling the first concave portions of the first printing member with ink; transferring the ink filling the first concave portions of the first printing member onto a blanket cylinder to form intermediate ink patterns; providing a second printing member including second concave portions formed by engraving patterns equal in size to the final ink patterns that are to be printed on the member, on the second printing member; closely attaching the blanket cylinder having the intermediate patterns to the second printing member to remove ink on portions of the blanket cylinder that contact convex portions of the second printing member, from the blanket cylinder; and printing ink that remains on the blanket cylinder, on the member to form the final ink patterns.

16 Claims, 9 Drawing Sheets

METHOD OF FORMING INK PATTERNS AND APPARATUS FOR PRINTING INK PATTERNS

This application claims priority from Korean Patent Application No. 10-2009-0068866 filed on Jul. 28, 2009 in the Korean Intellectual Property Office, the disclosure of which is incorporated herein by reference in its entirety.

BACKGROUND

1. Field of the Invention

The disclosure presented herein relates to a method of forming ink patterns and an apparatus for printing ink patterns, and more particularly, a method and an apparatus capable of reducing the amount of ink that is thrown away while enhancing the printing and positional precision of ink patterns on a member to be printed.

2. Description of the Related Art

As semiconductor devices, display devices, and other electronic devices are increasingly required to become lighter, smaller, and more highly integrated, micro-patterns such as wiring and insulating films are becoming more important. Therefore, the ability to form precise micro-patterns at the lowest possible cost is becoming the core of today's technological power. In particular, liquid crystal displays (LCDs), which are one of the most widely used types of flat panel displays, require wiring patterns, color filter patterns, spacer patterns, and the like therein to be precise micro-patterns. Accordingly, various methods of forming patterns are being researched.

A conventional photolithography process, which has been widely used in the semiconductor field, is being employed to form wiring patterns in an LCD. However, it is difficult to form precise patterns using the photolithography process due to the possibility of over-etching by an etchant or an etching gas. In addition, since the photolithography process involves complicated operations, manufacturing time and costs are increased. To address these disadvantages of the photolithography process, methods of forming patterns using an apparatus for printing ink patterns are being researched.

In a conventional method of forming micro-patterns, an ink layer is formed on the entire surface of a blanket cylinder by using slit coating. Then, the blanket cylinder is closely attached to a printing member having concave portions that are formed by engraving a shape of ink patterns to be printed on a member, on the printing member. When the blanket cylinder is closely attached to the printing member, ink on portions of the blanket cylinder that contact convex portions of the printing member is removed from the blanket cylinder. Finally, ink remaining on the blanket cylinder is printed on the member to form final ink patterns. However, when micro-patterns are formed using this method a large amount of ink is thrown away, resulting in a large loss in terms of material cost.

SUMMARY

Aspects of subject matter described herein provide a method of forming ink patterns and an apparatus for printing ink patterns capable of reducing the amount of ink that is thrown away and enhancing the printing and positional precision of ink patterns on a member to be printed.

However, aspects of the subject matter are not restricted to the one set forth herein. The above and other aspects will become more apparent to one of ordinary skill in the art to which it pertains by referencing the detailed description provided below.

According to an aspect of the subject matter described herein, there is provided a method of forming ink patterns. The method includes: providing a first printing member having first concave portions that are formed by engraving patterns larger than final ink patterns to be printed on a member, on the first printing member; filling the first concave portions of the first printing member with ink; transferring the ink filling the first concave portions of the first printing member onto a blanket cylinder to form intermediate ink patterns; providing a second printing member having second concave portions that are formed by engraving patterns equal in size to the final ink patterns to be printed on the member, on the second printing member; closely attaching the blanket cylinder having the intermediate patterns to the second printing member to remove ink on portions of the blanket cylinder that contact convex portions of the second printing member from the blanket cylinder; and printing ink that remains on the blanket cylinder on the member to form the final ink patterns.

According to another aspect of the subject matter described herein, there is provided an apparatus for printing ink patterns. The apparatus includes: a first printing member having first concave portions that are formed by engraving patterns larger than final ink patterns to be printed on a member, on the first printing member; a blanket cylinder onto which ink filling the first concave portions of the first printing member is transferred; a second printing member having second concave portions that are formed by engraving patterns equal in size to the final ink patterns to be printed on the member, on the second printing member and being closely attached to the blanket cylinder to remove ink on portions of the blanket cylinder that contact convex portions of the second printing member from the blanket cylinder; and a stage having the member on which ink remaining on the blanket cylinder is printed, loaded thereon.

BRIEF DESCRIPTION OF THE DRAWINGS

The above and other aspects and features will become more apparent by describing in detail exemplary embodiments thereof with reference to the attached drawings, in which.

DETAILED DESCRIPTION

Figure 1:
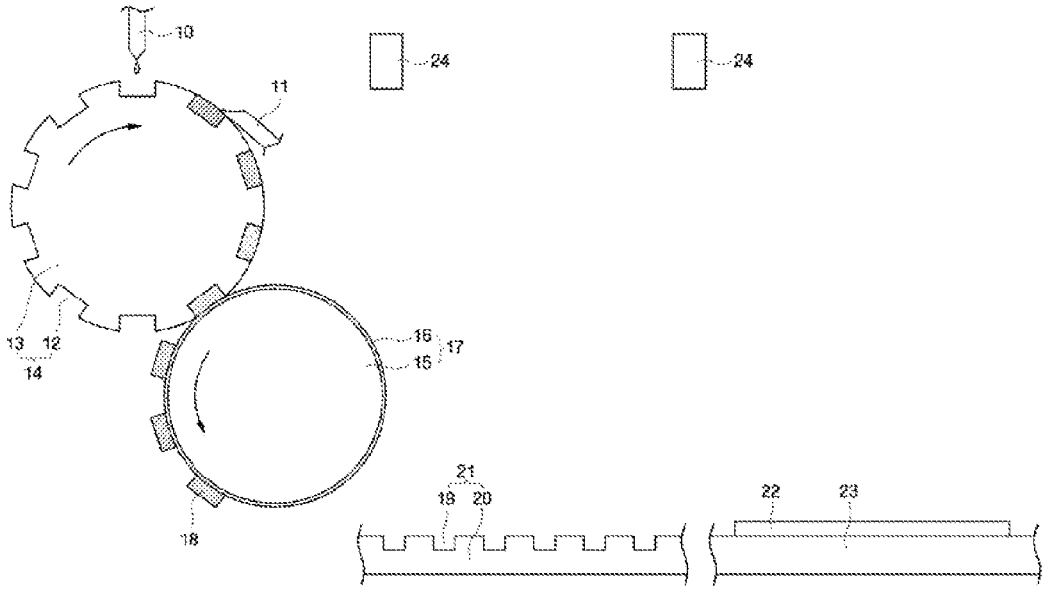
FIG. 1 is a cross-sectional view of an apparatus for printing ink patterns according to a first exemplary embodiment.

Advantages and features of the subject matter described herein, and methods of accomplishing the same may be understood more readily by reference to the following detailed description of exemplary embodiments and the accompanying drawings. The subject matter may, however, be embodied in many different forms and should not be construed as being limited to the embodiments set forth herein. Rather, these embodiments are provided so that this disclosure will be thorough and complete and will fully convey the concept of the subject matter to those skilled in the art, and will only be defined by the appended claims. In some embodiments, well-known processing processes, well-known device structures, and well-known technologies will not be specifically described in order to avoid ambiguous interpretation of the subject matter presented herein. Like numbers refer to like elements throughout.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" or "beneath" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated components, steps, operations, and/or elements, but do not preclude the presence or addition of one or more other components, steps, operations, elements, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, an apparatus for printing ink patterns and a method of forming ink patterns using the apparatus according to a first exemplary embodiment will be described in detail with reference to FIGS. 1 through 5.

FIG. 1 is a cross-sectional view of the apparatus for printing ink patterns according to the first exemplary embodiment. Referring to FIG. 1, the apparatus includes an ink supplier 10, a blade 11, a first printing member 14, a blanket cylinder 17, a second printing member 21, a stage 23 on which a member 22 to be printed is loaded, and aligners 24.

The first printing member 14 includes first concave portions 12 formed by engraving patterns larger than final ink patterns 25 (see FIG. 5) that are to be printed on the member 22, on the first printing member 14. The second printing member 21 includes second concave portions 19 formed by engraving patterns equal in size to the final ink patterns 25 that are to be printed on the member 22, on the second printing member 21.

Figure 2:
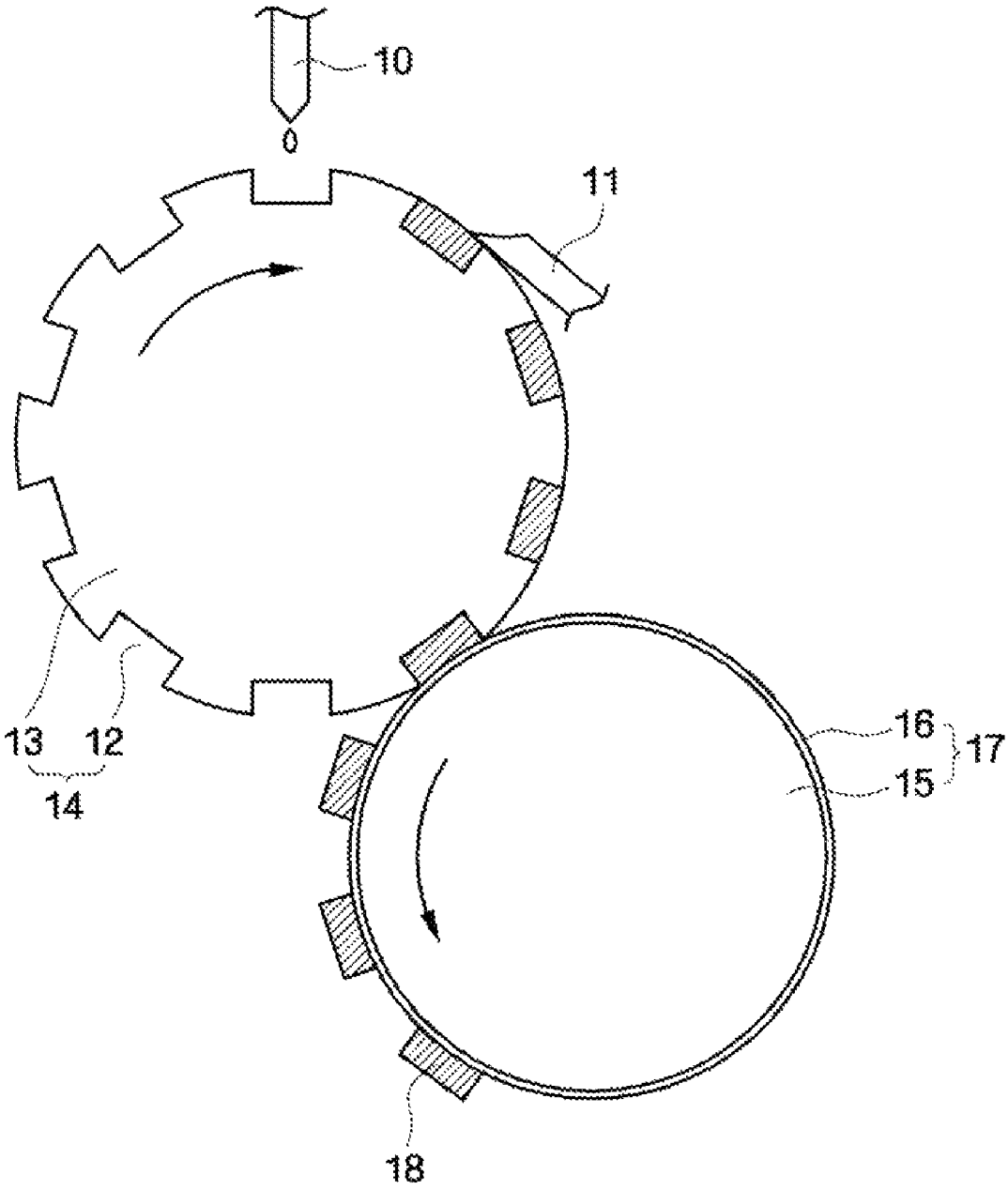
FIGS. 2 through 4 are cross-sectional views sequentially showing a method of forming ink patterns according to the first exemplary embodiment.
Figure 3:
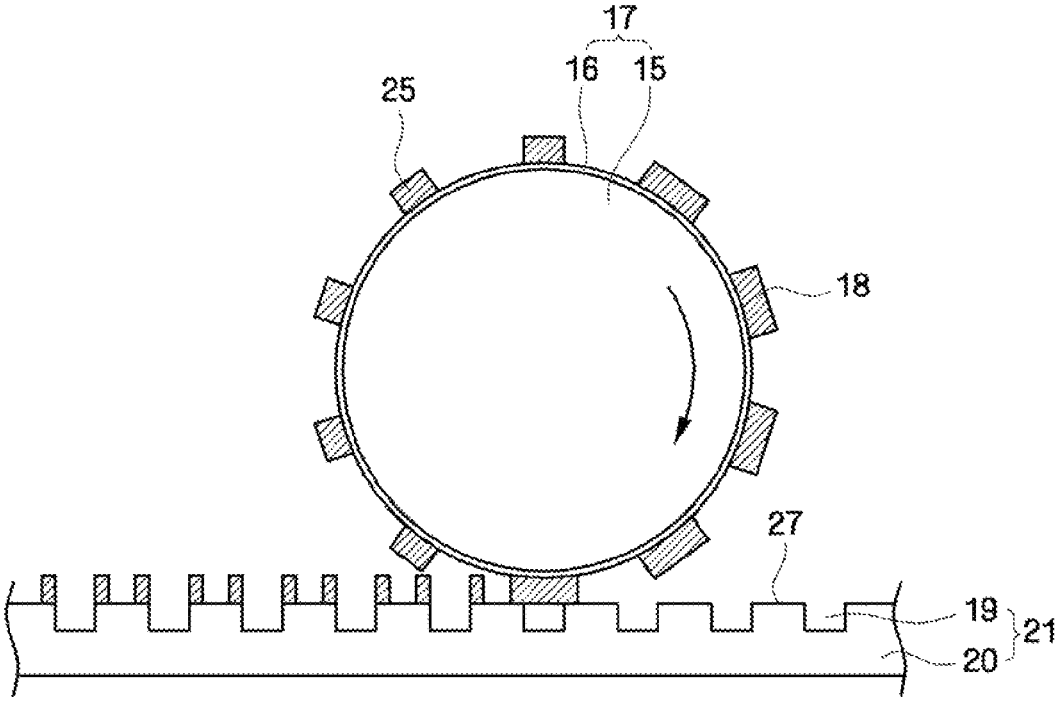
Figure 4:
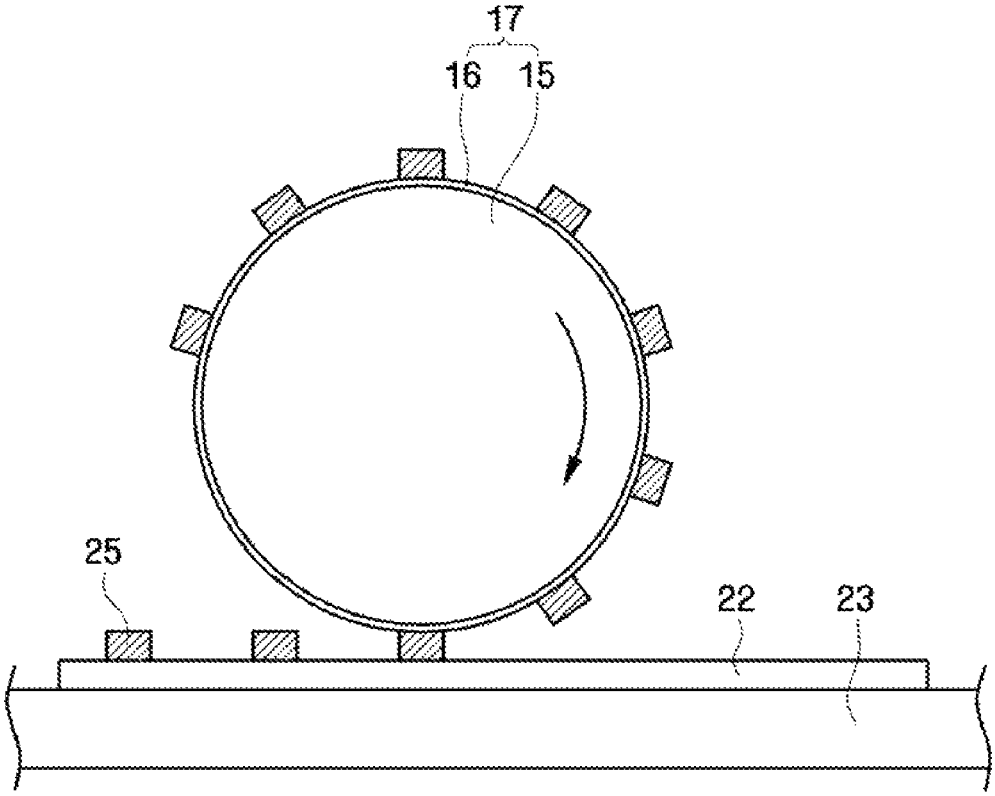
Figure 5:
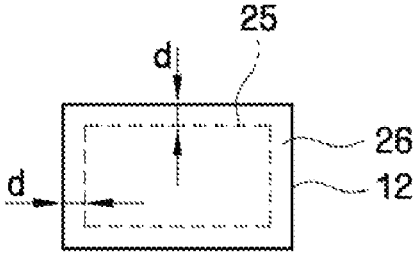
FIG. 5 is a plan view showing one of first concave portions to describe the sizes of the first concave portions and final ink patterns.

FIGS. 2 through 4 are cross-sectional views sequentially showing the method of forming ink patterns according to the first exemplary embodiment. FIG. 5 is a plan view showing one of the first concave portions 12 and the sizes of the first concave portions 12 and the final ink patterns 25.

Figure 7:
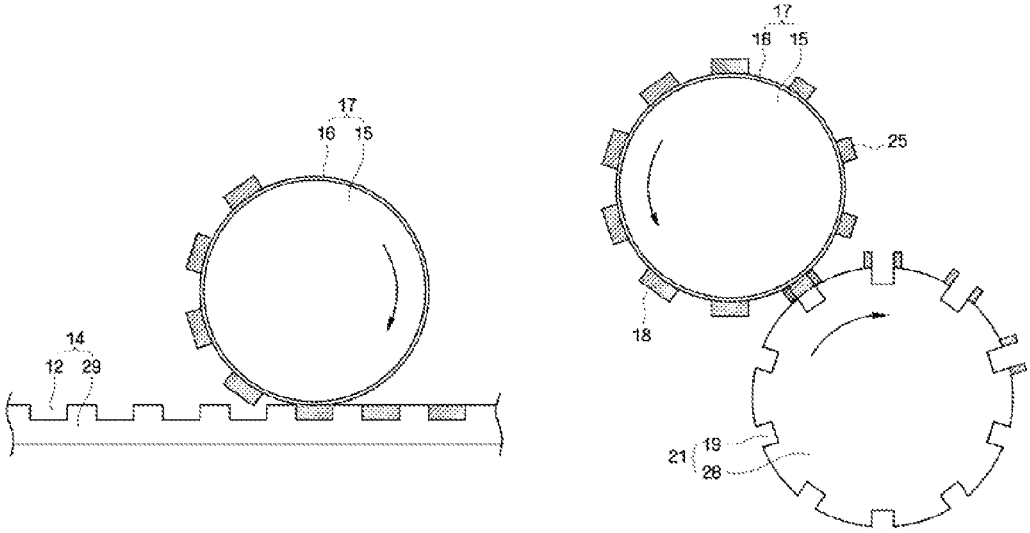
Figure 8:
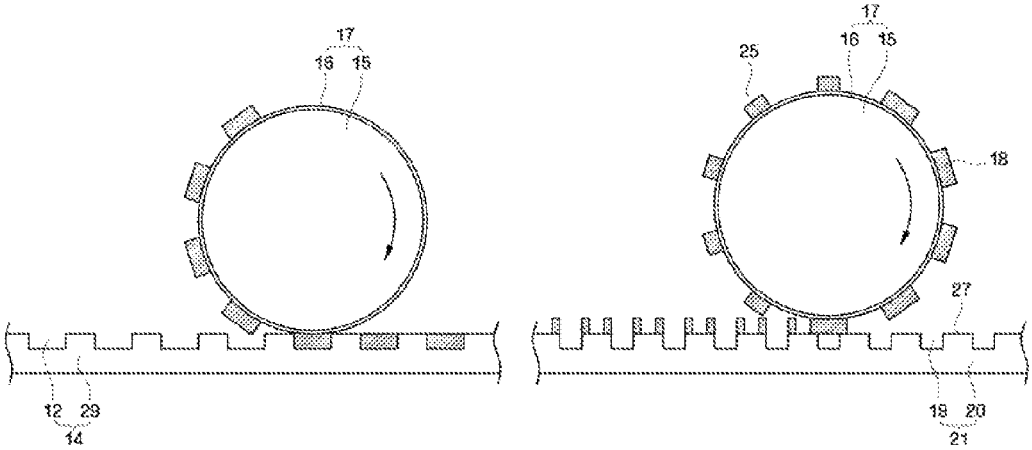

Referring to FIGS. 2 and 5, the first printing member 14 including the first concave portions 12 is provided. The first concave portions 12 are formed by engraving patterns larger than the final ink patterns 25 that are to be printed on the member 22, on the first printing member 14. The first printing member 14 may use a printing roller or a printing plate and may be made of glass, plastic, metal, or the like. In the current exemplary embodiment, the first printing member 14 is a printing roller 13 including the first concave portions 12. Since the first printing member 14 is used to form intermediate ink patterns 18, mass-productivity may be more desirable than precise position control. Thus, the printing roller 13 may be used as the first printing member 14 in order to enhance the mass-productivity of the first printing member 14. However, the first printing member 14 is not limited to the printing roller 13. As shown in FIGS. 7 and 8, a printing plate 29 may also be used as the first printing member 14.

The first concave portions 12 may be formed using a photolithography, molding, or laser-processing method. Referring to FIG. 5, each of the first concave portions 12 includes a region corresponding to a corresponding one of the final ink patterns 25 that are to be transferred onto the member 22, and a region corresponding to an area 26 around the corresponding one of the final ink patterns 25. Specifically, the first concave portions 12 are longer or wider than the final ink patterns 25. That is, when the final ink patterns 25 are placed at positions corresponding respectively to the first concave portions 12, edges of each of the final ink patterns 25 are within a corresponding one of the first concave portions 12. For example, the first concave portions 12 may be formed larger than the final ink patterns 25 such that each of the first concave portions 12 includes a region extending 1 to 50 μm from edges thereof to edges of a corresponding one of the final ink patterns 25. That is, a distance "d" in FIG. 5 may be 1 to 50 μm.

Referring to FIG. 2, ink is supplied from the ink supplier 10 to the first concave portions 12 of the first printing member 14. Since the blade 11 scrapes ink from unnecessary portions of the first printing member 14, ink can be supplied only to the first concave portions 12. The blade 11 may be shaped like a long plate. The blade 11 allows ink to fill only the first concave portions 12 by remaining in close contact with a surface of the first printing member 14 along a direction in which the first concave portions 12 are disposed while maintaining a predetermined angle with respect to a direction in which the first concave portions 12 extend.

Various materials may be used as ink depending on patterns to be formed, and resin or solvent added with different components may be used as ink. For example, a mixture of a bead spacer and a thermal hardener or an ultraviolet solvent may be used to form a spacer in a liquid crystal display (LCD), a photosensitive composition may be used to form a color filter and the like, and ink including metal powder may be used to form wiring patterns and the like. In addition, ink may not be in a liquid state but in a gel state with a certain viscosity.

Ink filling the first concave portions 12 of the first printing member 14 is transferred onto the blanket cylinder 17 to form the intermediate ink patterns 18. The blanket cylinder 17 may be formed by mounting a pad 16, which includes a material having certain release properties such as elastic rubber, around a roller 15. However, the embodiment is not limited thereto, and the blanket cylinder 17 may also be formed by coating the roller 15 with elastic rubber. Here, the elastic rubber may be, for example, silicon rubber.

The principles of transferring ink from the first concave portions 12 of the first printing member 14 onto the blanket cylinder 17 are as follows. If the first concave portions 12 and the blanket cylinder 17 are manufactured such that surface tension or friction of the first concave portions 12 is smaller than that of ink and that surface tension or friction of the blanket cylinder 17 is greater than that of the ink, the ink can be transferred onto the blanket cylinder 17 while the blanket cylinder 17 rotates in close contact with the first printing member 14.

In another method, a surface of each of the first concave portions 12 is charged to a positive or negative polarity, and ink is also charged to a polarity identical to that of the surface of each of the first concave portions 12. Accordingly, a repulsive force is created between the surface of each of the first concave portions 12 and the ink and causes the ink to drop from the surface of each of the first concave portions 12. In this case, if the blanket cylinder 17 is charged to a polarity different from that of the ink, the ink is transferred onto the blanket cylinder 17 while the blanket cylinder 17 rotates in close contact with the first printing member 14. The principles of transferring ink have been described above using a case where the ink is transferred from the first printing member 14 to the blanket cylinder 17 as an example. However, the same principles may apply to other processes which will be described later.

Each of the intermediate ink patterns 18 transferred onto the blanket cylinder 17 includes a region corresponding to a corresponding one of the final ink patterns 25 and a region corresponding to the area 26 around the corresponding one of the final ink patterns 25, wherein the region of each of the intermediate ink patterns 18, which corresponds to the area 26, is not transferred onto the member 22. The intermediate ink patterns 18 are not formed on the entire surface of the blanket cylinder 17. Instead, the intermediate ink patterns 18 are separated from each other at predetermined intervals.

Figure 6:
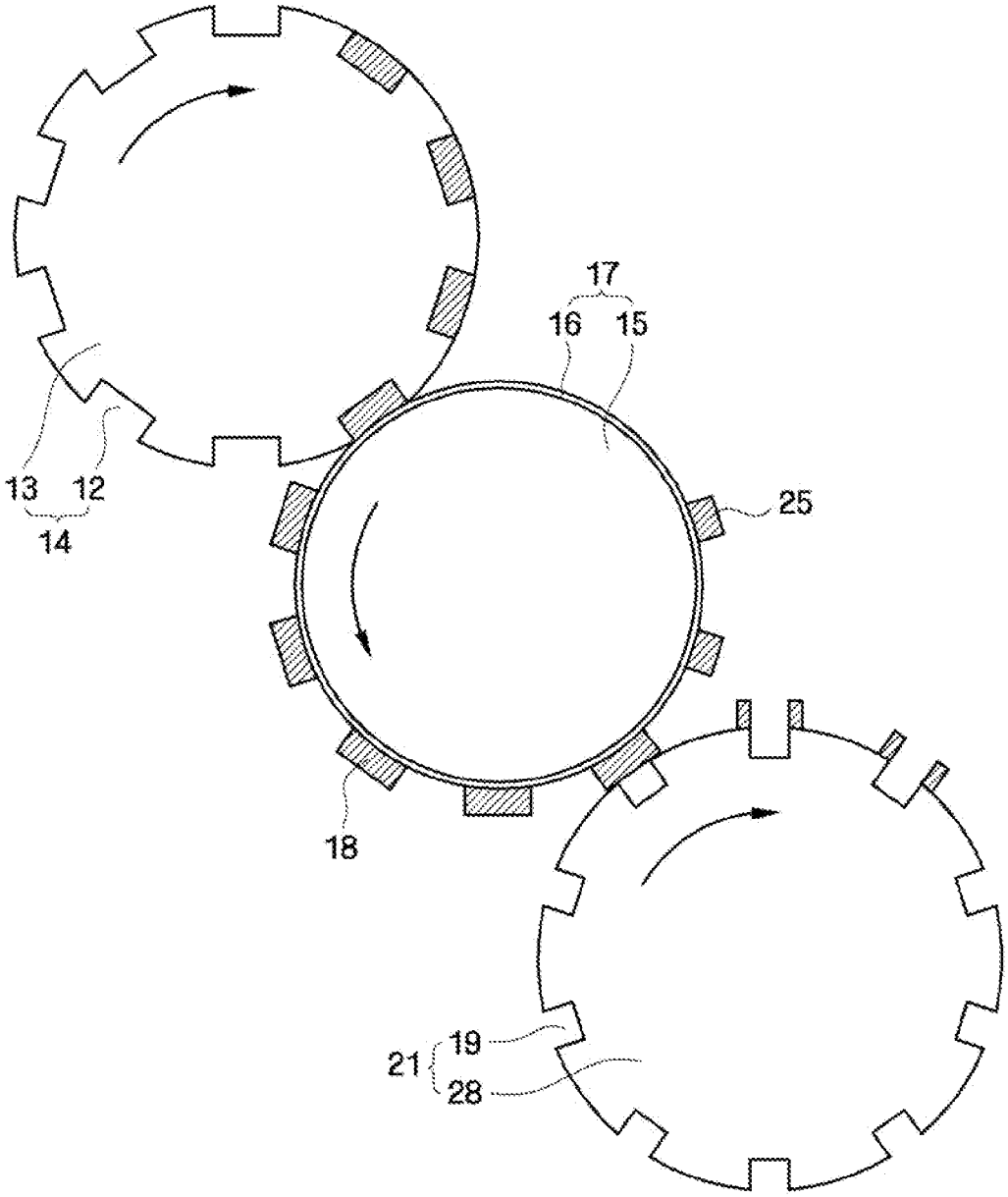
FIGS. 6 through 8 are cross-sectional views showing modified examples of a first printing member and a second printing member according to the first exemplary embodiment.

Referring to FIG. 3, the second printing member 21 including the second concave portions 19 is provided. The second concave portions 19 are formed by engraving patterns equal in size to the final ink patterns 25 that are to be printed on the member 22, on the second printing member 21. The second printing member 21 may use a printing roller or a printing plate and may be made of glass, plastic, metal, or the like. In the current exemplary embodiment, the second printing member 21 is a printing plate 20 including the second concave portions 19. In the current exemplary embodiment, since the second printing member 21 is used to form the final ink patterns 25, precise position control may be required. Thus, the printing plate 20 may be used as the second printing member 21 for efficient and precise position control. However, the second printing member 21 is not limited to the printing plate 20. As shown in FIGS. 6 and 7, a printing roller 28 may also be used as the second printing member 21.

The blanket cylinder 17 having the intermediate ink patterns 18 is closely attached to the second printing member 21 such that ink on portions of the blanket cylinder 17, that contacts convex portions 27 of the second printing member 21 can be removed from the blanket cylinder 17. Here, ink on portions of the blanket cylinder 17 that do not correspond to the final ink patterns 25 are transferred onto the convex portions 27 of the second printing member 21 and are thus removed from the blanket cylinder 17. The blanket cylinder 17 and the second printing member 21 may be accurately aligned at designated positions by using the aligners 24 (see FIG. 1), so that the intermediate ink patterns 18 formed on the surface of the blanket cylinder 17 can be transferred to exact positions on the second printing member 21.

Ink transferred onto the convex portions 27 of the second printing member 21 is thrown away. However, in the current exemplary embodiment, ink only on portions of the first printing member 14, which correspond to the final ink patterns 25 and the area 26 around each of the final ink patterns 25, is transferred onto the blanket cylinder 17 to form the intermediate ink patterns 18 and then is transferred again onto the second printing member 21. Thus, ink is not transferred onto the entire surface of each of the convex portions 27 of the second printing member 21. In the current exemplary embodiment, ink is transferred only onto predetermined regions on an end of each of the convex portions 27 of the second printing member 21. Therefore, according to the current exemplary embodiment, the amount of ink that is thrown away can be reduced.

In addition, since ink on the portions of the blanket cylinder 17, which do not correspond to the final ink patterns 25, is removed from the blanket cylinder 17 by using the second printing member 21, the printing precision of the shape of edges of ink remaining on the blanket cylinder 17 and the positional precision of the remaining ink on the member 22 can be enhanced. Therefore, even if the printing and positional precision of the intermediate ink patterns 18, which are transferred from the first printing member 14 onto the blanket cylinder 17, is somewhat low, the final ink patterns 25 can be formed to have a precise shape and have superior positional precision on the member 22 by using the second printing member 21.

Referring to FIG. 4, ink remaining on the blanket cylinder 17 is printed on the member 22 to form the final ink patterns 25. The member 22 may be, for example, a plastic substrate, paper, a glass substrate, a metal substrate, or the like. The blanket cylinder 17 and the member 22 may be accurately aligned with each other at designated positions by using the aligners 24, so that the ink remaining on the blanket cylinder 17 can be transferred to exact positions on the member 22.

The method of forming ink patterns shown in FIGS. 2 through 4 may be performed in-situ.

Modified examples of the first printing member 14 and the second printing member 21 will now be described with reference to FIGS. 6 through 8. FIGS. 6 through 8 are cross-sectional views showing modified examples of the first printing member 14 and the second printing member 21 according to the first exemplary embodiment of the present invention.

Referring to FIG. 6, a first printing member 14 is a printing roller 13 including first concave portions 12, and a second printing member 21 is the printing roller 28 including second concave portions 19.

Referring to FIG. 7, a first printing member 14 is the printing plate 29 including first concave portions 12, and a second printing member 21 is the printing roller 28 including second concave portions 19.

Referring to FIG. 8, a first printing member 14 is the printing plate 29 including first concave portions 12, and a second printing member 21 is a printing plate 20 including second concave portions 19.

Hereinafter, an apparatus for printing ink patterns and a method of forming ink patterns using the apparatus according to a second exemplary embodiment of the present invention will be described in detail with reference to FIGS. 9 and 10. For simplicity, elements substantially identical to those illustrated in the drawings for the first exemplary embodiment are indicated by like reference numerals and thus their description will be omitted, and differences between the first and second exemplary embodiments will mainly be described.

Figure 9:
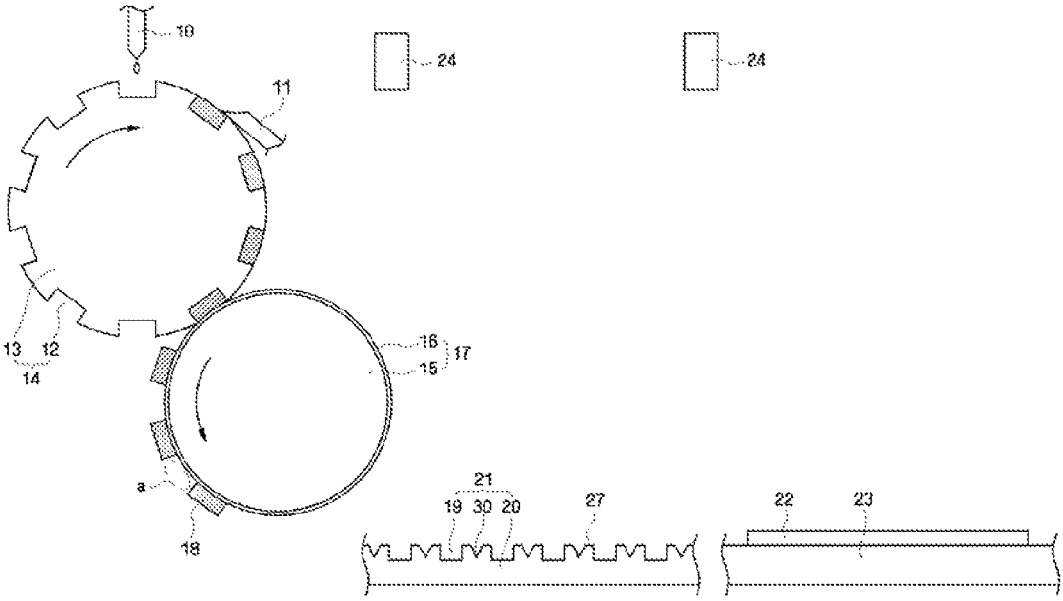
FIG. 9 is a cross-sectional view of an apparatus for printing ink patterns according to a second exemplary embodiment.

FIG. 9 is a cross-sectional view of the apparatus for printing ink patterns according to the second exemplary embodiment of the present invention. Referring to FIG. 9, unlike the apparatus according to the first exemplary embodiment, in the apparatus according to the second exemplary embodiment, a second printing member 21 includes second concave portions 19 and grooves 30 formed between the second concave portions 19. The second concave portions 19 are formed by engraving patterns equal in size to final ink patterns 25 that are to be printed on a member 22, on the second printing member 21.

In one embodiment, regions "a" uncoated with ink are created between intermediate ink patterns 18 on a blanket cylinder 17 before the blanket cylinder 17 contacts the second printing member 21. Thus, there is no need to remove ink from the regions "a," and, accordingly, convex portions 27 of the second printing member 21 need not contact the regions "a." Therefore, all or part of portions of the second printing member 21, which correspond to the regions "a" where the intermediate ink patterns 18 are not formed, that is, regions between the intermediate ink patterns 18, may be formed as the grooves 30.

Figure 10:
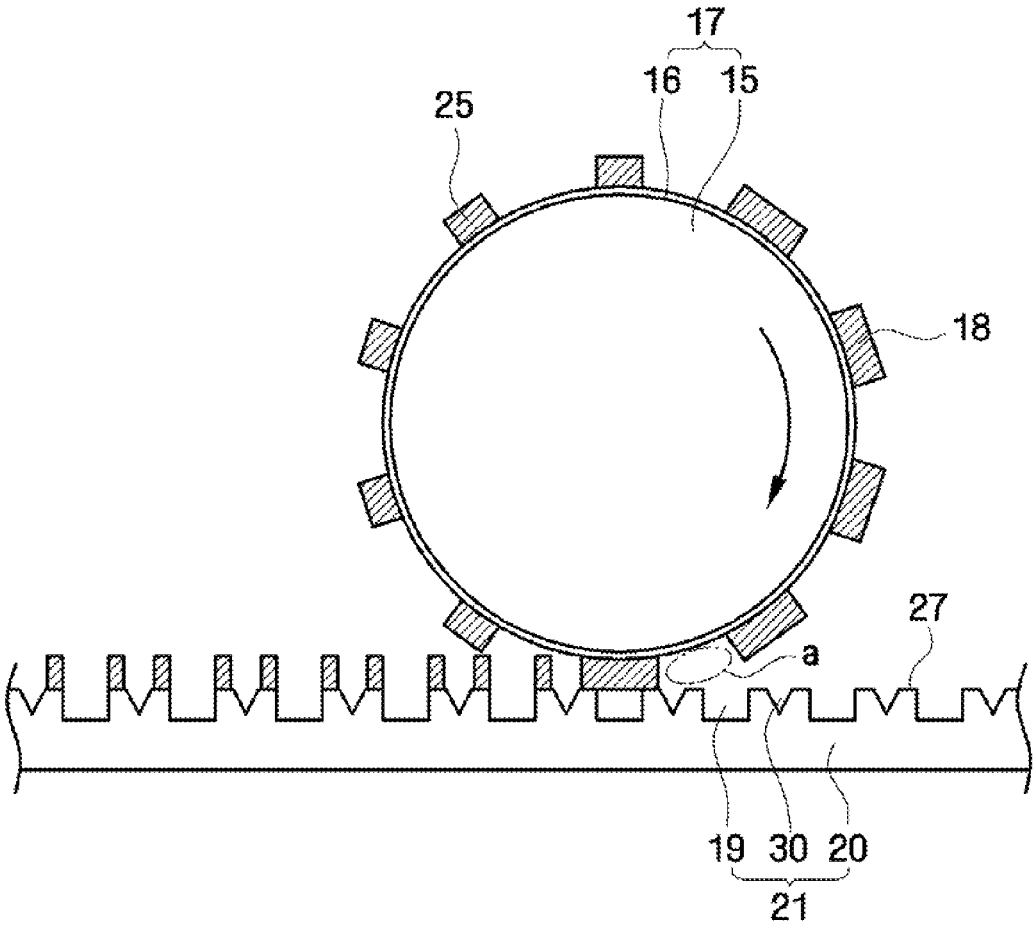
FIG. 10 is a cross-sectional view showing the process of removing ink from a blanket cylinder by using a second printing member of FIG. 9.

FIG. 10 is a diagram showing the method of forming ink patterns according to the second exemplary embodiment. Specifically, FIG. 10 is a cross-sectional view showing the process of removing ink from the blanket cylinder 17 by using the second printing member 21 of FIG. 9.

Referring to FIG. 2, first concave portions 12 of a first printing member 14 are filled with ink, and the ink is transferred onto the blanket cylinder 17 to form the intermediate ink patterns 18.

Referring to FIG. 10, the blanket cylinder 17 having the intermediate ink patterns 18 is closely attached to the second printing member 21 such that ink on portions of the blanket cylinder 17, which contact the convex portions 27 of the second printing member 21, can be removed from the blanket cylinder 17. Here, the second printing member 21 further includes the grooves 30 which correspond to the regions "a" which are not coated with ink and are interposed between the intermediate ink patterns 18. Thus, ink on portions of the blanket cylinder 17, which do not correspond to the final ink patterns 25, is removed from the blanket cylinder 17 by using the convex portions 27.

Figure 11:
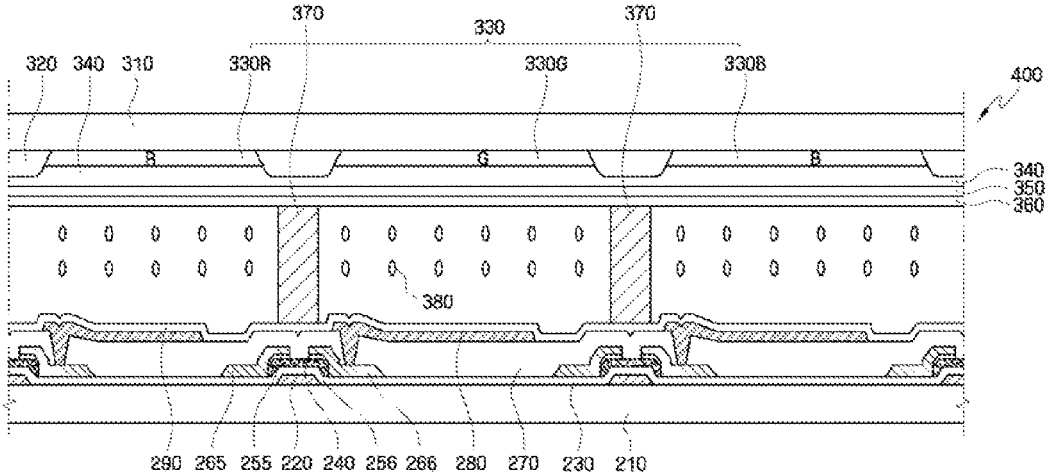
FIG. 11 is a diagram showing patterns that can be formed using a method of forming ink patterns.

FIG. 11 is a diagram showing patterns that can be formed using a method of forming ink patterns according to the present invention. In FIG. 11, an LCD is described as an example.

Referring to FIG. 11, gate electrodes 220 are formed on a first insulating substrate 210 of an LCD 400, and a gate insulating film 230 is formed on the gate electrodes 220. At least part of each of semiconductor layers 240 overlaps one of the gate electrodes 220, and the semiconductor layers 240 are insulated from the gate electrodes 220 by the gate insulating film 230. Source and drain electrodes 265 and 266 are formed above the semiconductor layers 240 with ohmic contact layers 255 and 256 interposed therebetween. The drain electrodes 266 are connected to pixel electrodes 280, respectively.

Meanwhile, black matrices 320 are formed under a second insulating substrate 310 that faces the first insulating substrate 210. The black matrices 320 block light, thereby preventing leakage of the light. The black matrices 320 may include an organic material. In addition, the black matrices 320 may include carbon black. Each of the black matrices 320 is formed around a pixel and is shaped like a bank. In addition, the black matrices 320 are arranged in a lattice structure. Pixel regions between the black matrices 320 are filled with red, green, and blue filters 330R, 330G, and 330B. A planarization film 340 and a common electrode 350 are formed under the black matrices 320 and color filters 330.

A cell gap is maintained between the first insulating substrate 210 and the second insulating substrate 310 by spacers 370 and is filled with liquid crystal molecules 380. In FIG. 11, the spacers 370 are column spacers. Alignment films 290 and 360, which can align the liquid crystal molecules 380, are disposed under and on a liquid crystal layer that includes the liquid crystal molecules 380.

The gate electrodes 220, the semiconductor layers 240, the source electrodes 265, the drain electrodes 266, the pixel electrodes 280, the black matrices 320, the color filters 330, and the spacers 370 included in the LCD 400 can be formed using a method of forming ink patterns according to the present invention. However, the subject matter presented herein is not limited thereto, and the method of forming ink patterns can be applied to various fields of forming ink patterns on a member.

While the subject matter presented herein has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. A method of forming ink patterns, the method comprising:

providing a first printing member comprising first concave portions which are formed by engraving patterns larger than final ink patterns that are to be printed on a member, on the first printing member;

filling the first concave portions of the first printing member with ink;

transferring the ink filling the first concave portions of the first printing member onto a blanket cylinder to form intermediate ink patterns;

providing a second printing member comprising second concave portions formed by engraving patterns equal in size to the final ink patterns that are to be printed on the member, on the second printing member;

closely attaching the blanket cylinder having the intermediate ink patterns to the second printing member to remove ink on portions of the blanket cylinder that contact convex portions of the second printing member, from the blanket cylinder; and printing ink, which remains on the blanket cylinder, on the member to form the final ink patterns.

2. The method of claim 1, wherein the first printing member is a printing roller or a printing plate.

3. The method of claim 2, wherein the second printing member is a printing plate or a printing roller.

4. The method of claim 1, wherein the first concave portions are longer and wider than the second concave portions.

5. The method of claim 4, wherein a top surface of each of the convex portions of the second printing member comprises a region to which ink is not transferred.

6. The method of claim 4, wherein the second printing member further comprises grooves between the second concave portions.

7. The method of claim 1, being performed in-situ.

8. The method of claim 1, further comprising accurately aligning the intermediate ink patterns on the blanket cylinder with the second printing member at designated positions by using aligners before the closely attaching of the blanket cylinder having the intermediate patterns to the second printing member to remove the ink on the portions of the blanket cylinder that contact the convex portions of the second printing member, from the blanket cylinder.

9. The method of claim 1, wherein each of the first concave portions comprises a region corresponding to a corresponding one of the final ink patterns and a region extending 1 to 50 μm from edges thereof to edges of the corresponding one of the final ink patterns.

10. An apparatus for printing ink patterns, the apparatus comprising:

a first printing member comprising first concave portions formed by engraving patterns larger than final ink patterns that are to be printed on a member, on the first printing member;

a blanket cylinder onto which ink filling the first concave portions of the first printing member is transferred;

a second printing member comprising second concave portions formed by engraving patterns equal in size to the final ink patterns that are to be printed on the member, on the second printing member and being closely attached to the blanket cylinder to remove ink on portions of the blanket cylinder that contact convex portions of the second printing member, from the blanket cylinder; and a stage having the member, on which ink remaining on the blanket cylinder is printed, loaded thereon.

11. The apparatus of claim 10, wherein the first printing member is a printing roller or a printing plate.

12. The apparatus of claim 11, wherein the second printing member is a printing plate or a printing roller.

13. The apparatus of claim 10, wherein the first concave portions are longer and wider than the second concave portions.

14. The apparatus of claim 13, wherein a top surface of each of the convex portions of the second printing member comprises a region to which ink is not transferred.

15. The apparatus of claim 13, wherein the second printing member further comprises grooves between the second concave portions.

16. The apparatus of claim 10, wherein each of the first concave portions comprises a region corresponding to a corresponding one of the final ink patterns and a region extending 1 to 50 μm from edges thereof to edges of the corresponding one of the final ink patterns.

* * * * *